United States Patent [19]

Plym

[11] 4,435,930

[45] Mar. 13, 1984

[54] TRAFFIC SAFE POLE

[76] Inventor: Oscar W. Plym, Generalsvägen 133, 180 21 Österskär, Sweden

[21] Appl. No.: 196,570

[22] Filed: Oct. 14, 1980

[51] Int. Cl.[3] ..... E04H 12/02; E04B 1/54

[52] U.S. Cl. ..... 52/98; 52/309.1; 404/10

[58] Field of Search ..... 52/38, 40, 726, 296, 52/98–100, 309.1; 40/607, 610, 612; 404/10; 256/13.1; 138/172, 174; 285/235

[56] References Cited

U.S. PATENT DOCUMENTS

| | | | |
|---|---|---|---|
| 1,463,461 | 7/1923 | Davis | 285/287 |
| 2,351,275 | 6/1944 | McConnel | 403/305 |
| 2,722,237 | 11/1955 | Rosel | 138/174 |
| 3,100,555 | 8/1963 | Ashton | 52/309.1 |
| 3,204,355 | 9/1965 | Whitman | 40/607 |
| 3,516,446 | 6/1970 | O'Hargan et al. | 285/109 |
| 3,796,057 | 3/1974 | Dougherty | 285/398 |
| 4,056,591 | 11/1977 | Goettler et al. | 264/108 |
| 4,270,873 | 6/1981 | Laehy et al. | 404/10 |

*Primary Examiner*—James L. Ridgill, Jr.
*Attorney, Agent, or Firm*—LeBlanc, Nolan, Shur & Nies

[57] ABSTRACT

A traffic safe pole for supporting traffic signs, road lighting and the like.

The pole is characterized in that it is divided substantially perpendicularly to its longitudinal direction preferably in one place and, thus, comprises a first portion (1), to which, for example, a traffic sign (2) is intended to be attached, and jointed to said first portion a second portion (3) intended to be anchored in a suitable way, for example in the ground (4).

The pole further is characterized in that said joint substantially consists of a sleeve (6,12,30) so arranged, that its tensile strength in substantially its longitudinal direction considerably exceeds the tensile strength in its circumferential direction. Said sleeve (6,12,30) further is attached, preferably by glueing, to the outer (9,10) or inner (14,15,32,33) shell surface of said pole portions (1,3) at a tubular pole and to the shell surface (9,10) of said portions (1,3) at a homogenous pole.

According to a preferred embodiment, said sleeve (6) consists of reinforced plastic with directed reinforcement, the longitudinal direction (7) of which substantially coincides with the longitudinal direction of said sleeve (6), which sleeve (6) is glued on the outer shell surface (9,10) of the pole portions (1,3).

7 Claims, 4 Drawing Figures

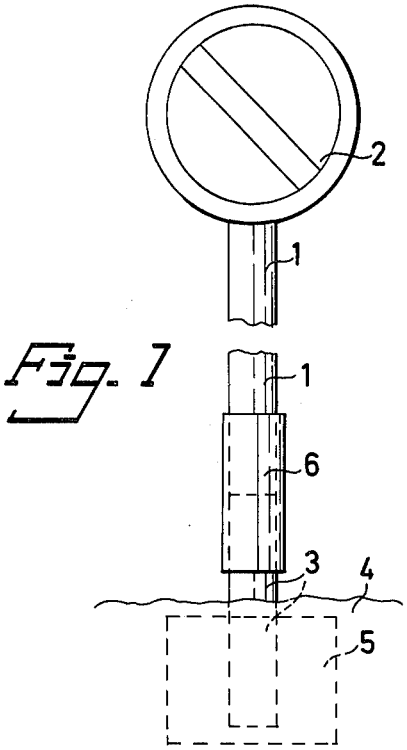
Fig. 1
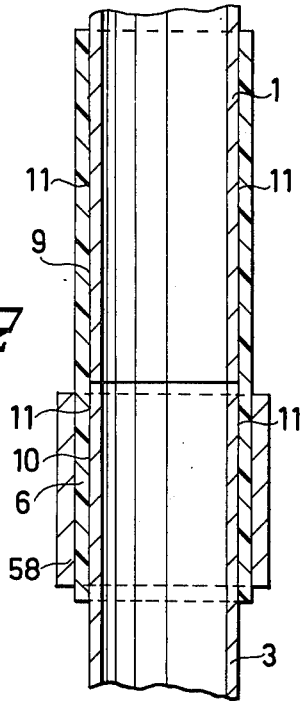
Fig. 2
Fig. 3
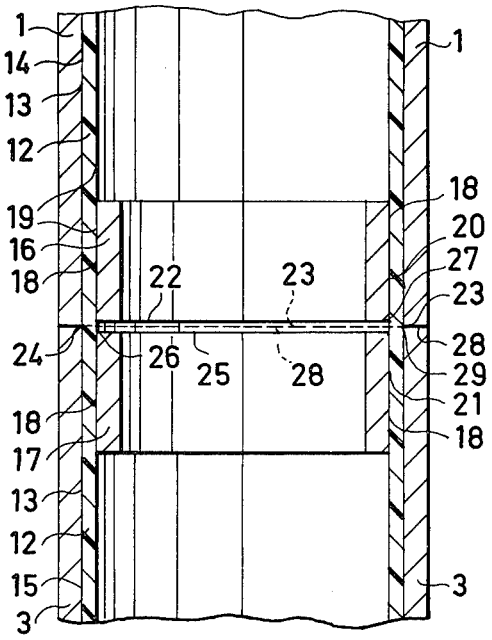
Fig. 4
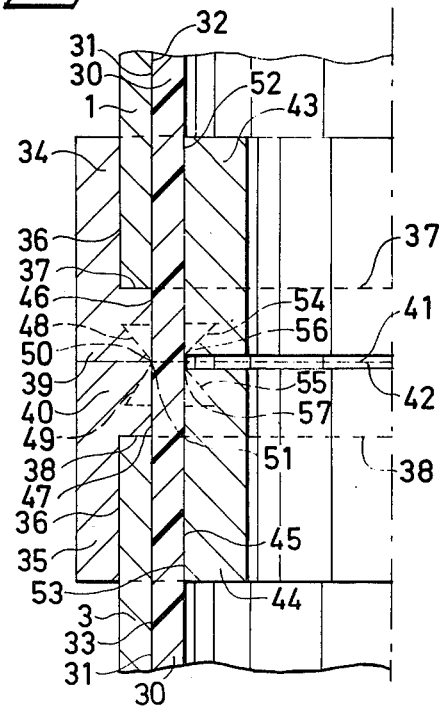

TRAFFIC SAFE POLE

This invention relates to a traffic safe pole intended to support road traffic signs, road lighting and the like.

At present the traffic on roads and streets is controlled very comprehensively. In connection therewith, a great number of poles supporting traffic signs and the like have been erected. Pole-supported road lighting, too, has been extended substantially.

Poles of this kind are positioned in close contact with the traffic, thereby giving rise to problems, because they constitute a traffic risk. Very many collisions with poles have occurred, which resulted in serious personal injuries and material damages.

There exists, therefore, a great demand for traffic safe poles. A traffic safe pole correctly designed must meet several requirements. For example, when a traffic sign pole is subjected to collision by a car, the pole must break off at about ground level and swing upward over the car roof, so that the passengers are injured and the car is damaged to a minimum possible extent. The pole, further, must withstand flexural stresses of such size and kind, as they arise, for example, when a person leans against or climbs on a pole or shakes the same. The pole also must resist wind load etc. and, of course, be cheap to manufacture and require relatively cost for its repair. The two lastmentioned requirements are not met, for example, by the lattice road lighting poles at present in use.

It may be added that the problems referred to above substantially are the same when railing poles, airfield poles etc. are concerned The present invention relates to poles solving the aforesaid problems, and, thus, relates to a traffic safe pole.

The invention is characterized in that said pole is divided substantially perpendicularly to its longitudinal direction preferably in one place and, thus, comprises a first portion, to which, for example, a traffic sign is intended to be attached, and a second portion, which is joined together with the first portion and intended to suitably be anchored, for example in the ground, and that the joint substantially consists of a sleeve so arranged, that its tensile strength substantially in its longitudinal direction considerably exceeds the tensile strength in the circumferential direction of the sleeve, and that said sleeve is attached, preferably glued, to the outer or inner shell surface of said portions at a homogenous pole.

The invention and embodiments of a pole according to the invention are described in the following with reference to the accompanying drawing, in which FIG. 1 is a schematic view of a first embodiment of a traffic safe pole according to the present invention, FIG. 2 is a section through a joint at a pole according to FIG. 1, FIG. 3 is a section through a joint at a second embodiment of a pole according to the present invention, and FIG. 4 is a section through a joint at a third and a fourth embodiment of a pole according to the present invention.

In FIG. 1, the numeral 1 designates a first portion of a pole according to the present invention, to which portion 1, for example, a traffic sign 2 is intended to be attached. The numeral 3 designates a second portion of a pole according to the invention, which portion is intended to suitably be anchored, for example, in the ground 4 by a foundation 5 as shown in FIG. 1.

Said portions 1,3 can be imagined constituting the two portions of a preferably cylindrical steel pole, which originally has been coherent and was divided substantially perpendicularly to its longitudinal direction. The number of portions preferably is only two, but also more portions, for example three, can be imagined, which are brought about in the same manner as the portions 1,3.

The portions 1,3 are joined together at their end surfaces, and their longitudinal direction substantially coincide, as shown in FIGS. 1 and 2. The joint consists substantially of a sleeve 6, which is so arranged and selected that its tensile strength substantially in its longitudinal direction, i.e. vertical direction in FIGS. 1 and 2, considerably exceeds its tensile strength in substantially its circumferential direction. The sleeve 6 consists, for example, of reinforced plastic with directed reinforcement.

A sleeve 6 having the said properties can be produced in several ways. The reinforcement in the sleeve preferably consists of directed glass fibre, the fibre direction of which substantially coincides with the longitudinal direction of the sleeve 6. As an alternative to glass fibre, for example carbon fibre, Kevlar, wire-sheets or the like can be used, the fibres or corresponding details whereof are arranged in relation to the longitudinal direction of the sleeve 6 in a way corresponding to that described for glass fibre. An extruded pipe, for example, which can be manufactured without any reinforcement in circumferential direction, can be used as sleeve.

The sleeve 6 is attached, preferably by glueing, to the outer shell surface 9,10 of said portions 1,3. For obtaining a strong glue joint, the outer surface 9,10 of the portions 1,3 is pre-treated at the place of the joint in a suitable manner, for example by providing circumferential grooves of a suitable depth. The grooves are not shown in FIGS. 1 and 2.

The object is to render the joint capable to resist flexural stresses of the kind, which occur when, for example, a person leans against the pole. Between the sleeve 6 and the portions 1,3, thus, a glue layer is located.

The end surfaces of the pole portions 1,3 which are intended to abut each other, must be formed with such precision that a good steel to steel contact is obtained. At bending, namely, the main part of the pressure load is taken up by the pole portions 1,3, and the object is that the high compressive strength of the steel shall be utilized. This applies in principle also to the embodiments described in the following.

It is obvious that the sleeve 6 can either be prefabricated and in that case possibly be slotted for providing a good joint in view of dimension tolerances of the pole portions 1,3, and be threaded on the outside of the pole portions 1,3 when they are being positioned as intended relative to one another, or the sleeve may be formed by winding a glass fibre fabric about the place of the joint when the portions 1,3 are being joined together.

The function of a traffic safe pole according to the aforedescribed embodiment is as follows. The length above ground 4 of the pole portion 3 is adjusted so that a passenger car passing over the portion 3 substantially does not contact said portion. At a collision, the bumper of the car will meet the lower part of the portion 1, i.e. at the joint or slightly above the same. The sleeve 6 is thereby split open, spread in its longitudinal direction, because its tensile strength in circumferential direction is low. The lower part of the pole portion 1, thus, will follow along with the car while its upper part is delayed in movement due to inertia. As a result, thus, the lower part of the pole portion 1 is forced onward in the car movement direction and upward, while its upper part is not moved correspondingly. The pole portion 1, thus, will rotate so as to pass above the car roof. By varying said transverse reinforcement, the desired resistance of the sleeve to being split open can be obtained.

In this way, the personal injuries and vehicle damages will be small, and the pole easily can be repaired after the collision.

In FIG. 3 a second embodiment of a traffic safe pole according to the invention is shown. The pole portions 1,3, which at this embodiment necessarily are tubular and, as at the above embodiment, preferably cylindric, are arranged in a manner corresponding to that shown in FIGS. 1 and 2. A sleeve 12 having the aforesaid properties is provided within said pole portions 1,3 and preferably glued by a glue layer 13 laid between the sleeve 12 and the inner shell surface 14,15 of the portions 1,3 as appears from FIG. 3.

A first ring 16 and a second ring 17, preferably of steel, are provided within the sleeve 12 and fixed thereto, for example glued to it by a glue layer 18 laid between the inner sleeve shell surface 19 and the outer shell surface 20,21 of the rings 16,17. The first steel ring 16 is located within said first pole portion 1, so that its end surface 22 lies in the same plane as the end surface 23 of the pole portion or insignificantly inserted in the pole portion 1. The second ring 17 is located in corresponding manner within the pole portion 3.

The function of this embodiment of a pole according to the invention is as follows. The length above the ground 4 of the pole portion 3 is adjusted as described above. At a collision, the lower part of the pole portion 1, at the joint or slightly above, is subjected to a substantially horizontal force, directed for example to the right in FIG. 1. The sleeve 12 is hereby shorn off to the left of the centre line in FIG. 3 between the inner edge 24 of the end surface 23 of the pole portion 1 and the outer edge 26 of the end surface 25 of the ring 17. To the right of the centre line in FIG. 3 the sleeve 12 is cut off between the outer edge 27 of the end surface 22 of the ring 16 and the inner edge 29 of the end surface 28 of the pole portion 3.

The result with respect to the movement of the pole portion 1 is the same as described with reference to the embodiment shown in FIGS. 1 and 2.

In FIG. 4 a third and a fourth embodiment of a safety pole according to the invention are shown. The pole portions 1,3 at these embodiments necessarily are tubular and, as before, preferably cylindric. A sleeve 30 having the aforesaid properties is located within said pole portions 1,3 and preferably glued by a glue layer 31 laid between the sleeve 30 and the inner shell surface 32,33 of the portions 1,3 as shown in FIG. 4.

At the joint, at each of said pole portions 1,3, a ring 34,35, preferably of steel, is provided on the outside of and fixed, for example glued by a glue layer 36, to the pole portions 1,3. The ring 34,35 projects in the longitudinal direction of the pole portion 1,3 beyond the end surface 37,38 of the pole portion. The inner diameter of the projecting portion 39,40 is substantially the same as the inner diameter of the pole portion 1,3. The ring, thus, constitutes a cylindric cup on the end of the pole portion 1,3, which cup is provided in its bottom with an axial hole, the diameter of which substantially is the same as the inner diameter of the pole portion, as appears from FIG. 4.

The end surfaces 41,42 of the projecting portion 39,40 of the rings 34,35 are arranged so as to abut each other. The pole portions 1,3 which are intended to rest in the rings 34,35, thus, are located somewhat spaced from each other, as shown in FIG. 4.

A first ring 43 and a second ring 44, preferably of steel, are provided within the sleeve 30 and fixed, for example glued, to its inner shell surface 45, so that said first ring 43 is located within said first pole portion 1 and projects in the longitudinal direction beyond the end surface 37 of the pole portion 1 substantially as much as or slightly less than said cup-shaped ring 34. Said second ring 44 is arranged in corresponding manner in the second pole portion 3.

The aforesaid fourth embodiment is the same as the one described last, with the exception that grooves indicated by dashes in FIG. 4 are made in the rings 34,35,43, 44.

The inner shell surface 46,47 of the projecting portion 39, 40 of each of said cup-shaped rings 34,35 comprises in this case a groove 48,49 in circumferential direction in connection to the end surface 41,42 of the projecting portion 39,40, which groove 48,49 is arranged so that the flank 48,49 of the groove 48,49 which is located closest to said end surface 41,42 and the end surface 41,42 together form a sharp edge 50,51 about the inner edge 50,51 of said end surface 41,42.

The outer shell surface 53,53 of the projecting portion of said first ring 43 and said second ring 44 is provided with a groove 54,55 in circumferential direction in connection to the end surface of the projecting portion in a manner corresponding to that at the cup-shaped rings 34,35, so that a sharp edge 56,57 is formed about the outer edge 56,57 of said end surface.

The function of these two embodiments of a pole according to the present invention agrees substantially with the function of the embodiment shown in FIG. 3. At a collision, the sleeve 30 is shorn off, cut off between the edges of the rings 34, 35,43,44 at the end surfaces of the projecting portions of the rings. The embodiments according to FIG. 4 are structures of greater stability than the one shown in FIG. 3. By choosing a suitable material for the ring, for example hardened steel, and by means of special sharp edges 50,51,56,57 the cutting effect can be improved, if so required.

As has appeared from above, the invention provides a simple and cheap solution of the problems referred to above in the introductory portion.

It is, of course, possible to imagine a great number of embodiments of a pole according to the invention and also minor alterations, without abandoning the invention idea.

Examples of different suitable sleeve materials have been mentioned, but more materials can be imagined.

It also has been mentioned that it is possible and suitable to adjust the shell surfaces of the pole portions at the joint to the desired function of the glue connection, by providing grooves in circumferential direction, i.e. perpendicularly to the longitudinal direction of the pole.

The resistance against flexural stresses depending on the length of the sleeve, and therewith of the glue joint, the sleeve length required at large expected stresses, for example at poles for road lighting, can be substantial and thereby give rise to problems of anchoring the pole.

An outer sleeve according to FIGS. 1 and 2 then can be completed by a reinforcement against splitting, for example a clamping ring having in principle the function like a hose clip, which ring is attached on the pole portion to be anchored. The sleeve length required is hereby reduced. Such a reinforcement is shown schematically in FIG. 2.

The invention, thus, must not be regarded restricted to the above embodiments, but is variable within the scope defined in the attached claims.

I claim:

1. A traffic safe pole for supporting traffic signs, road lighting and the like, characterized in that the pole is divided substantially perpendicularly to its longitudinal direction to thereby comprise a first pole portion to which a traffic sign and the like may be attached; and a second pole portion jointed to said first portion adapted to be anchored in a suitable manner; said joint substantially consisting of a sleeve secured to and arranged relative to the two pole portions so that its tensile strength in substantially its longitudinal direction which is coextensive with the pole portions considerably exceeds the tensile strength in its circumferential direction; said pole portions being structurally coextensive with coextensive surfaces; said sleeve consisting of reinforced plastic with its reinforcement provision directed in the longitudinal direction of the sleeve; the means for securing said sleeve to said pole portions consisting of glue which glues the sleeve to coextensive surfaces of said pole portions to thereby provide a homogenous pole; said sleeve being located on the inner shell surface of said pole portions; a ring, preferably of steel, located and glued on the outside of each of said pole portions at the joint, where each ring projects in longitudinal direction of the pole portion beyond the end surface of the associated pole portion, and where the inner diameter of the projecting portion of the ring substantially agrees with that of the pole portion, each ring constituting a cylindric cup located on the end of the associated pole portion with an axial hole in the cup bottom, and the end surfaces of the projecting portions of the rings arranged so as to abut each other; a first inner ring and a second inner ring, preferably of steel, located within said sleeve and glued to its inner shell surface in such a manner, that said first inner ring is located within said first pole portion and projects in the longitudinal direction beyond the end surface of the pole portion a distance substantially equal to but no greater than said end surfaces of said cup-shape ring, and said second inner ring is located in corresponding manner within said other pole portion; said traffic safe pole being further characterized in that in the inner shell surface of the projecting portion of each of said cup-shaped rings a circumferential groove is provided in connection to the end surface of the projecting portion, which groove is arranged so that the flank of the groove which is closest to said projecting end surface and the projecting end surface together form a sharp edge about the inner edge of said projecting end surface, and that the outer shell surface of the projecting portion of said first inner ring and said second inner ring includes a groove which is located in the circumferential direction in connection to the end surface of the projecting portion in a manner corresponding to the cup-shaped rings so that a sharp edge is formed about the outer edge of said projecting end surface.

2. A traffic safe pole for supporting traffic signs, road lighting and the like, characterized in that the pole is divided substantially perpendicularly to its longitudinal direction to thereby comprise a first pole portion to which a traffic sign and the like may be attached; and a second pole portion joined to said first portion adapted to be anchored in a suitable manner; said joint substantially consisting of a sleeve secured to and arranged relative to the two pole portions so that its tensile strength in substantially its longitudinal direction which is coextensive with the pole portions considerably exceeds the tensile strength in its circumferential direction; said pole portions being structurally coextensive with coextensive surfaces; said sleeve being a short peripheral wall structure, the peripheral wall structure consisting of plastic and elongate plastic reinforcement means which are directed in the longitudinal direction of the sleeve wall structure; and the means for securing said sleeve to said pole portions consisting of glue which glues the sleeve to extensive surfaces of said pole portions to thereby provide a homogenous pole.

3. A traffic safe pole as defined in claim 2, characterized in that said sleeve (12) is located and glued on the inner shell surface (14,15) of said portions, and that a first ring (16) and a second ring (17), preferably of steel, are provided within said sleeve (12) and glued to its inner shell surface (19), in such a manner, that the first steel ring (16) is located in said first pole portion (1), one end surface (22) thereof lying substantially in the same plane as the end surface (23) of the pole portion (1) or slightly inserted into the pole portion (1), and the second steel ring (17) is located in corresponding manner within said second pole portion (3).

4. A traffic safe pole as defined in claim 2, characterized in that said sleeve (30) is located and glued on the inner shell surface (32,33) of said portions (1,3) and that a ring (34,35), preferably of steel, is located and glued on the outside of each of said pole portions (1,3) at the joint, where the ring (34,35) projects in longitudinal direction of the pole portion (1,3) beyond the end surface (37,38) of the pole portion (1,3), and where the inner diameter of the projecting portion (39,40) of the ring (34,35) substantially agrees with that of the pole portion (1,3), and that, thus, the ring (34,35) constitutes a cylindric cup located on the end of the pole portion (1,3), with an axial hole in the cup bottom, and the end surfaces (41,42) of the projecting portions (39,40) of the rings (34,35) are arranged so as to abut each other, and that a first ring (43) and a second ring (44), preferably of steel, are located within said sleeve (30) and glued to its inner shell surface (45) in such a manner, that said first ring (43) is located within said first pole portion (1) and projects in the longitudinal direction beyond the end surface (37) of the pole portion (1) substantially as much as or slightly less than said cup-shaped ring (34,35), and said second ring (44) is located in corresponding manner within said second pole portion (3).

5. A traffic safe pole as defined in claim 2, characterized in that the portions of the shell surfaces (9,10,14,15,32,33) of the pole portions (1,3) which are intended to be jointed at said sleeve (6,12,30) are provided with grooves extending in the circumferential direction of the pole portions.

6. A traffic safe pole as defined in claim 2, wherein said sleeve is glued to outer coextensive shell surfaces of said pole portions.

7. A traffic safe pole as defined in claim 6, characterized in that a reinforcement (58), clamping ring (58), is provided on the outside of that portion of the sleeve (6) which is attached to the shell surface (10) of said second pole portion (3).

* * * * *

UNITED STATES PATENT AND TRADEMARK OFFICE

CERTIFICATE OF CORRECTION

PATENT NO. : 4,435,930

DATED : March 13, 1984

INVENTOR(S) : Oscar W. Plym

It is certified that error appears in the above-identified patent and that said Letters Patent is hereby corrected as shown below:

1. In Column 6, On Line 3, Change "joined" to --jointed--.

Signed and Sealed this

*Fourth* Day of *June 1985*

[SEAL]

*Attest:*

DONALD J. QUIGG

*Attesting Officer* *Acting Commissioner of Patents and Trademarks*